US006430784B1

(12) United States Patent
Dudek et al.

(10) Patent No.: US 6,430,784 B1
(45) Date of Patent: Aug. 13, 2002

(54) COMPLEMENTARY FASTENER PRODUCT

(75) Inventors: Chester P. Dudek, Marietta; James Hutcherson, Norcross; Kiichiro Ishikawa; Tomonari Yoshida, both of Marietta, all of GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 09/928,351

(22) Filed: Aug. 14, 2001

Related U.S. Application Data

(63) Continuation of application No. 09/802,992, filed on Mar. 12, 2001.

(51) Int. Cl.[7] ..... A44B 18/00; B65D 63/00

(52) U.S. Cl. ..... 24/306; 24/16 R; 24/442; 24/DIG. 11

(58) Field of Search ..... 24/306, 442, DIG. 11, 24/265 C, 16 R, 130; 128/DIG. 15; 2/912; 428/100

(56) References Cited

U.S. PATENT DOCUMENTS 2,931,747 A * 4/1960 Dexter ..... 24/DIG. 11
3,640,273 A * 2/1972 Ray ..... 128/DIG. 15
4,094,021 A * 6/1978 Rapp
4,706,914 A * 11/1987 Ground ..... 24/306
4,759,963 A * 7/1988 Uso, Jr. et al. ..... 24/442
4,862,563 A * 9/1989 Flynn ..... 24/442
5,136,759 A * 8/1992 Armour, II ..... 24/442
5,142,743 A * 9/1992 Hahn ..... 24/16 R
5,214,874 A * 6/1993 Faulkner ..... 24/442
5,289,619 A * 3/1994 Pileggi ..... 24/306
5,669,120 A * 9/1997 Wessels et al.
6,049,953 A * 4/2000 McCay et al. ..... 24/306

FOREIGN PATENT DOCUMENTS

JP 62-203739 * 12/1987
JP 10-115307 * 5/1998

* cited by examiner

*Primary Examiner*—Victor Sakran
(74) *Attorney, Agent, or Firm*—Kramer & Associates P.C.

(57) ABSTRACT

A fastener assembly is disclosed which includes a first fastener strip having on at least one side a first fastening surface. Also provided is a second fastener strip having on at least one side a second fastening surface that is complementary to the first fastening surface. The first fastener strip overlies the second fastening surface of the second fastener strip with the first fastening surface not facing the second fastening surface. The first and second fastener strips are releasably connected.

20 Claims, 6 Drawing Sheets

COMPLEMENTARY FASTENER PRODUCT

CROSS REFERENCE TO RELATED APPLICATIONS

This application is a continuation in part of U.S. patent application Ser. No. 09/802,992 filed Mar. 12, 2001, now pending.

BACKGROUND OF THE INVENTION

1. Field of the Invention

This invention generally relates to complementary fastener strip products. In particular, this invention relates to the manufacture and ready to use dispensing of complementary fastener strips for more efficient manufacture of furniture cushion attachments.

2. Description of Related Art

Complementary fastener strips are well know in the art and are used for a large variety of applications. These complementary fasteners include hook and loop fasteners manufactured in many configurations. U.S. Pat. No. 5,669,120, issued to Roger Thor, Wessels et al. discloses a representative molded surface fastener which illustrates one construction of the hook and loop fasteners currently know in the art. Said fastener comprises molded hook elements and loop elements made of fibers which are mixedly distributed. The complementary fasteners currently known may be manufactured through extrusion, molding and injection-molding techniques, among other methods of manufacture. These types of fasteners may also be constructed through a weaving or knitting process to produce the finished product.

Complementary fastener strips are commonly used in many applications for releasably attaching and removing different articles of manufacture. An example of such use is illustrated in U.S. Pat. No. 5,136,759 issued to Thomas W. Armour, H. In Armour, II a multipurpose fastening device is used for securing items to stationary objects, or alternatively, for bundling elongated items of rope-like material. Armour, II discloses a webbing product, preferably constructed from either nylon or polypropylene, having hook and loop surfaces on one or both faces of the webbing. The webbing may be of different lengths and is used for attachment of, for example, soccer nets to goal posts and securing sails of a sailboat to a mast.

Another application of such complementary fasteners may be found in U.S. Pat. No. 4,094,021, issued to Robert A. Rapp. Rapp utilizes tie members, in the form of complemental fastening means, to attach a pool cover to the side walls of a pool below the pool deck. The complemental fastening means are secured to the pool cover through the use of rivets. The pool cover may then be extended above the surface of the pool and safely secured to the bordering side walls.

The furniture industry, and more particularly, the outdoor furniture industry utilizes complementary fasteners to fasten various articles to its furniture. In particular, there is a need for cushions to be removably secured to outdoor furniture. Outdoor furniture must ordinarily deal with adverse weather conditions such as wind, rain and snow. During periods of use, it is advantageous to secure cushions to outdoor furniture for greater comfort. During periods of non-use it is preferable to remove these cushions for storage and to prevent deterioration of said cushions due to their exposure to the elements. Complementary fastener strips prove to be particularly useful for this industry since the cushions may be secured to the furniture during use and may then be easily removed for storage.

In the manufacture of outdoor furniture cushions, it is presently the preferred practice to withdraw a desired length of complementary fastener strip, withdraw a second length of complementary fastener strip, and cut these in equal lengths. The strips are then sown to the cushion liner or the internal cushion filler.

Preassembled fastener strips present other problems. During shipment they tend to twist and bend such that the complementary faces attach to one another. This presents a problem for manufacturers who use the preassembled fastener strips.

Although the use of complementary fastener strips for attaching or securing objects is well know in the art, there continues to be a need for providing an efficient and cost effective process for providing such complementary fastener strips, in a ready to use configuration, during the manufacture of many of the products which rely on these essential articles of manufacture.

Thus, it is an object of the present invention to provide for the efficient and cost effective dispensing of preassembled complementary fastener strips for attachment to articles.

It is another object of the present invention to provide a first and second length of complementary fastener strips. Binding said fastener strips, and providing a container for dispensing said complementary fastener strip product.

It is a further object of the present invention to provide for the more efficient and cost effective manufacture of articles of manufacture which require the use of complementary fasteners in their fabrication.

It is a further object of the present invention to provide preassembled fastener strips which do not twist and become tangled during transit or handling.

The foregoing objects and advantages of the invention are illustrative of those that can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variation which may be apparent to those skilled in the art. Accordingly, the present invention resides in the novel methods, arrangements, combinations and improvements herein shown and described.

SUMMARY OF THE INVENTION

In light of the present need for providing an efficient and cost effective process for providing complementary fastener strips, a brief summary of the present invention is presented. Some simplifications and omission may be made in the following summary, which is intended to highlight and introduce some aspects of the present invention, but not to limit its scope. Detailed descriptions of a preferred exemplary embodiment adequate to allow those of ordinary skill in the art to make and use the invention concepts will follow in later sections.

A fastener assembly is disclosed which includes a first fastener strip having on at least one side a first fastening surface. Also provided is a second fastener strip having on at least one side a second fastening surface that is complementary to the first fastening surface. The first fastener strip overlies the second fastening surface of the second fastener strip with the first fastening surface not facing the second fastening surface. The first and second fastener strips are releasably connected.

BRIEF DESCRIPTION OF THE DRAWINGS

In order to better understand the present invention, reference is made to the accompanying drawings, wherein.

DETAILED DESCRIPTION OF THE PREFERRED EMBODIMENTS OF THE INVENTION

Figure 1:
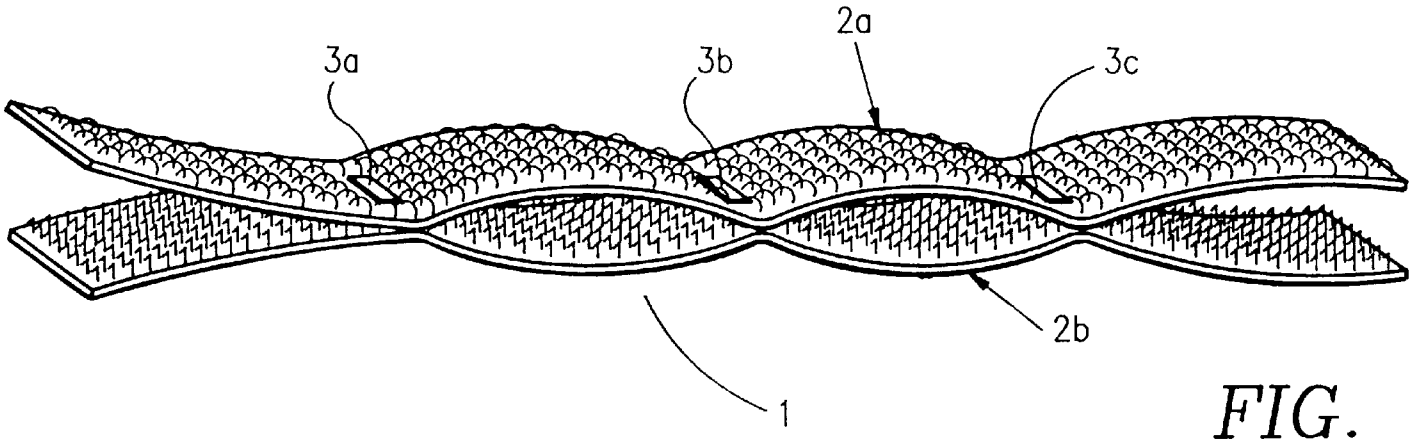
FIG. 1 shows a perspective view of one of the embodiments of the complementary fastener strip product.

Referring now to the drawings, in which like numerals refer to like components or steps, there are disclosed broad aspects of the preferred embodiments of the present invention. The embodiments shown include complementary fasteners which may be manufactured according to manufacturing processes commonly know in the art. These include extrusion, molding, injection-molding, weaving, knitting techniques, as well any other manufacturing processes commonly know for the manufacture of such fasteners. By complementary fasteners, the present invention encompasses the numerous products which allow for one portion of material having a profiled structure, to complementary engage a second portion of material having a profiled structure. These include hook and loop, surface fasteners, mating fasteners and other complementary devices having a profiled structure. In a preferred embodiment, the complementary fastener strips may include complementary profiled structures on either one or both sides of the strip.

Figure 2:
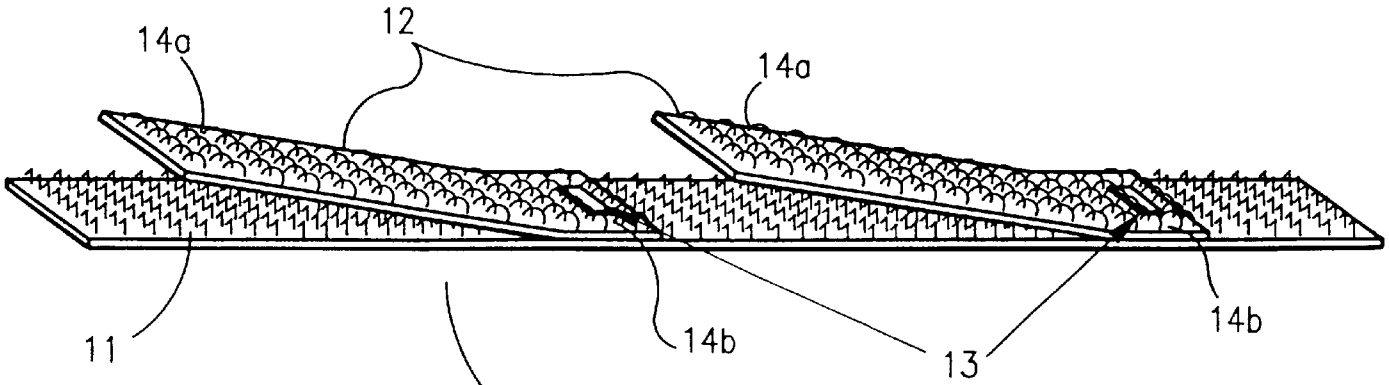
FIG. 2 shows a perspective view of one of the embodiments of the complementary fastener strip product.

FIG. 1 discloses a general arrangement of a complementary fastener strip product. The product consists of a first length of complementary fastener strip material 2*a*, and a second length of complementary fastener stip material 2*b*. The material is bound together at spaced intervals 3*a*, 3*b*, 3*c* to provide an indefinite length complementary fastener strip product 1. Another preferred embodiment of the present invention is shown in FIG. 2, which discloses an alternate embodiment of the complementary fastener strip product 1. In FIG. 2, a first length of complementary fastener strip material 11 is provided. Multiple lengths of complementary fastener strip material 12 are also provided having a first end 14*a* and a second end 14*b*. The multiple lengths of complementary fastener strip material 12, are then bound at one end 14*b*, to the first length of complementary fastener strip material 11, at spaced intervals 13, thereby securing the second end 14*b*, and allowing the first end 14*a* to remain free.

Figure 4:
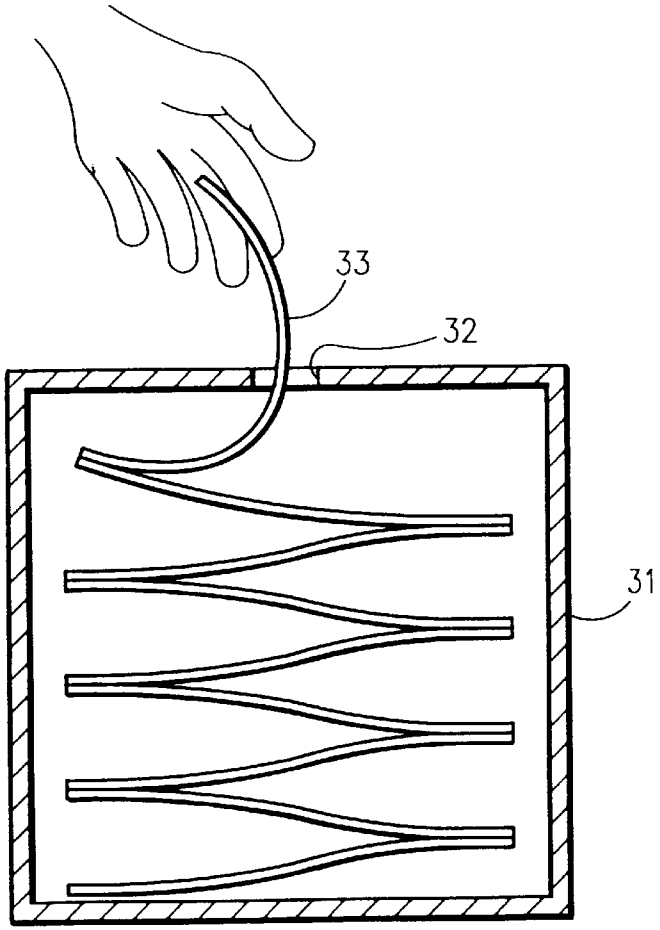
FIG. 4 shows a side cut-away view of one of the embodiments of the complementary fastener strip product dispenser.
Figure 3:
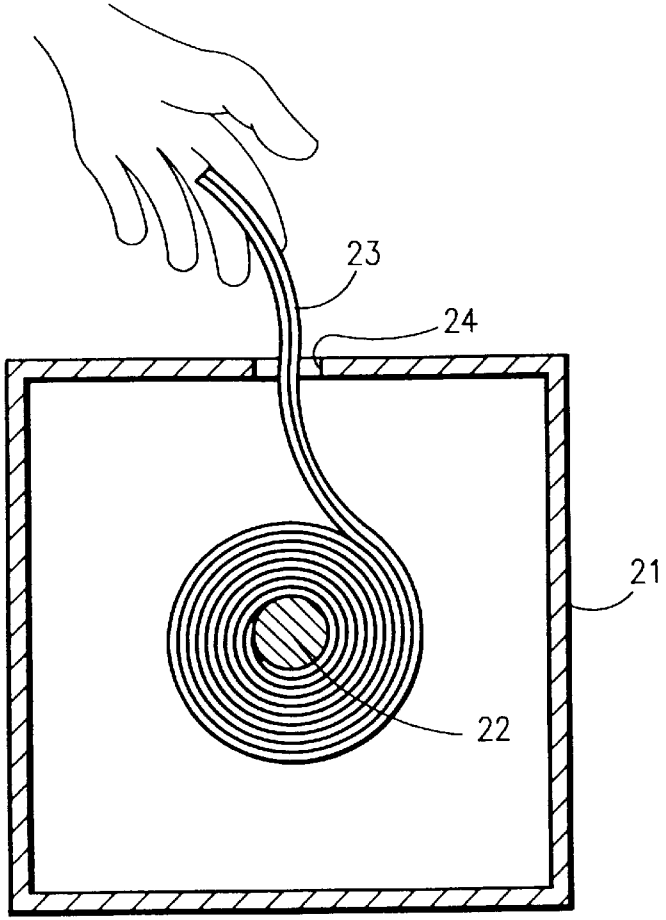
FIG. 3 shows a side cut-away view of one embodiment of the complementary fastener strip product dispenser.

FIG. 3 discloses a general arrangement for a complementary fastener strip dispenser. The preferred embodiment consists of a container 21, having a central axle 22, for holding a complementary fastener strip product 23, and a dispensing opening 24, for allowing access to the strip product 23. It should be understood that although central axle 22 is disclosed in the preferred embodiment, the present invention is not limited as such, in that other devices that perform the function of facilitating the spinning of the rolled up strip product 23 may be employed. For example, detent balls on either side of container 21 that can mate with opposite ends of a central member disposed inside of a roll strip product 23, may be used. Moreover, a central axle or the like is not required in that a roll of strip product 23 may be disposed in container 21 to rotate freely when strip product 23 is removed. FIG. 4 shows an alternative embodiment for a complementary fastener strip dispenser. A container 31, is filled with. a complementary fastener strip product 33. The container 31, also includes a dispensing opening 32, for allowing access to the strip product 33.

The complementary fastener strip products shown in FIGS. 1 or 2 are placed in the container 21 shown in FIG. 3 in a circular fashion. This packaging configuration allows for the continuous access to the complementary fastener strip product 23, through the container dispensing opening 24. Alternatively, the complementary fastener strip products shown in FIGS. 1 or 2 may be placed in the container 31 shown in FIG. 4, in a stacked fashion. This alternative packaging configuration also allows for continuous access to the complementary fastener strip product 33, through the container dispensing opening 32.

Figure 5:
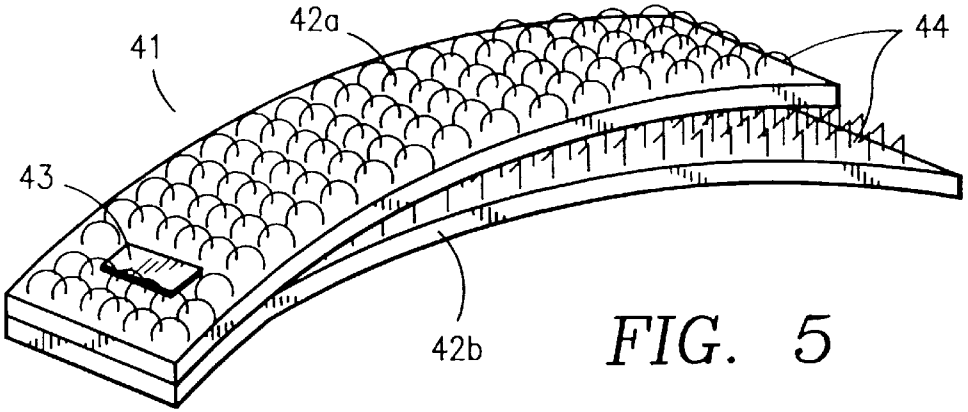
FIG. 5 shows a perspective view of one of the products which result from the present invention.
Figure 6:
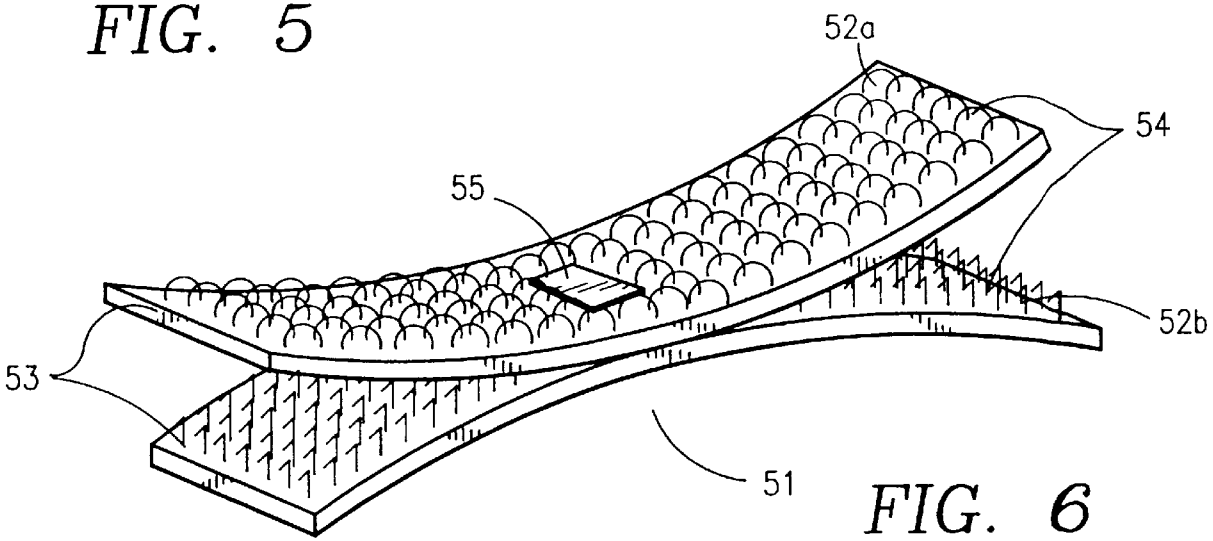
FIG. 6 shows a perspective view of one of the products which results from the present invention.

In use, container 21, as shown in FIG. 3, is placed in a convenient place, such as a furniture cushion manufacturing facility, and the complementary fastener strip product 23 is removed through the container dispensing opening 24. The complementary fastener strip product 23 may be as embodied in FIG. 1. As the complementary fastener strip product 1 embodied in FIG. 1 is withdrawn from the container 21, it may be severed at a point intermediate to binding points 3*a* and 3*b*, and immediately proximate to binding point 3*a*. The resulting product 41 is shown in FIG. 5, having two strips of complementary fastener 42*a*, 42*b* bound at one end 43, and unbound at its opposite end 44. The complementary fastener strip product 1 may also be severed at a point substantially intermediate to binding points 3*a* and 3*b*, and not immediately proximate to binding points 3*a* or 3*b*. The resulting product 51 is shown in FIG. 6, having two strips of complementary fastener 52*a*, 52*b* bound at a point 55 substantially intermediate to the two ends of the product 53, 54. The resulting product may then be attached to an article, such as an outdoor furniture cushion. The product may also be attached to the internal filler of the outdoor furniture cushion or to the exterior liner.

Figure 7:
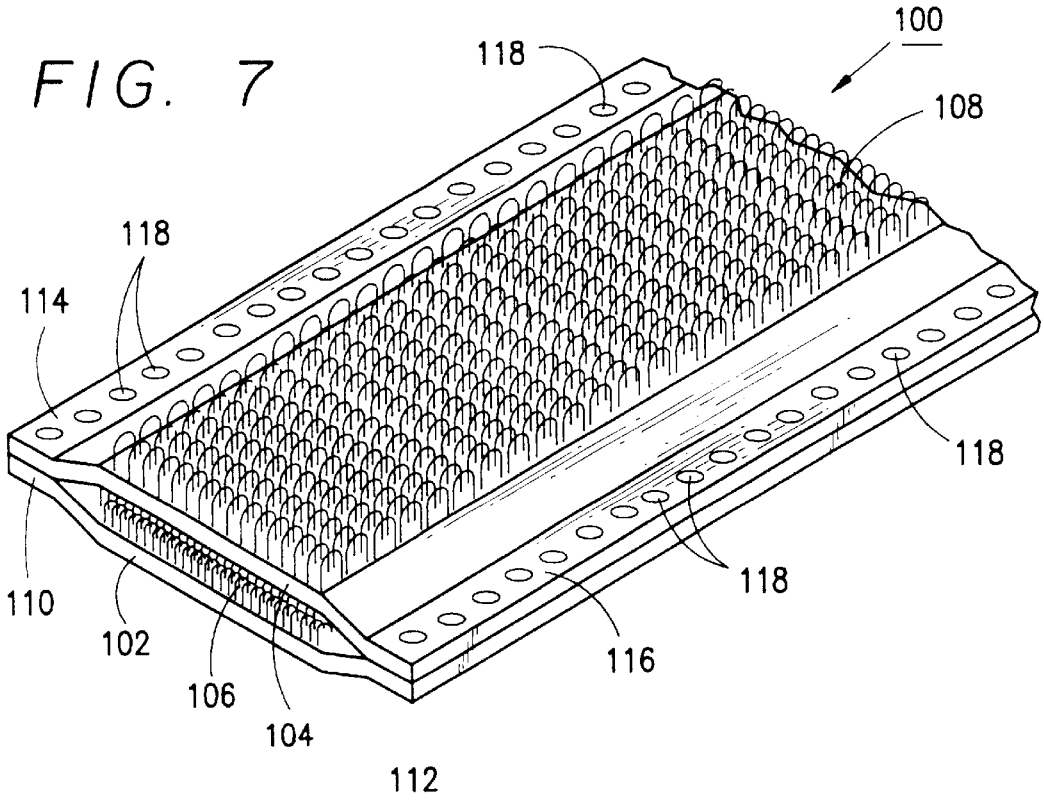
FIG. 7 shows a detail view of another embodiment of the fastener assembly using a series of bonds.

FIG. 7 shows an additional embodiment of the present invention. The fastener assembly 100 includes a first fastener strip 102 and a second fastener strip 104. The first fastener strip 102 includes a first fastening surface 106. The second fastener strip 104 includes a second fastening surface 108. The first fastening surface 106 and the second fastening surface 108 are complementary to one another. The surfaces 106 and 108 can be a hook and loop pair or any other type of mating surface. The first fastening surface 106 covers one side of the first fastener strip 102 running the entire length of the first fastener strip 102. The second fastening surface 108 covers one side of the second fastener strip 104 and runs the entire length of the second fastener strip 104. The second fastener strip 104 overlies the first fastening surface 106 of the first fastener strip 102. The second fastening surface 108 of the second fastener strip 104 does not face or touch the first fastening surface 106 of the first fastener strip 102. The fastener assembly 100 is provided by the manufacture in strips of predetermined lengths.

The first fastener strip 102 also includes a first edge 110 and a second edge 112. Likewise, the second fastener strip 104 includes a first edge 114 and a second edge 116. The edges 110 and 112 of the first fastener strip 102 are bonded to the edges 114 and 116 of the second fastener strip 104. In this embodiment, multiple bond points 118 are shows along the entire length of the fastener assembly 100. The preferred method of bonding is via ultrasonic welds. However, it should be noted that any bonding method including sonic welding, welding, sewing and gluing can be used as long as the bond can be broken without destroying fastener strips 102 and 104.

Figure 8:
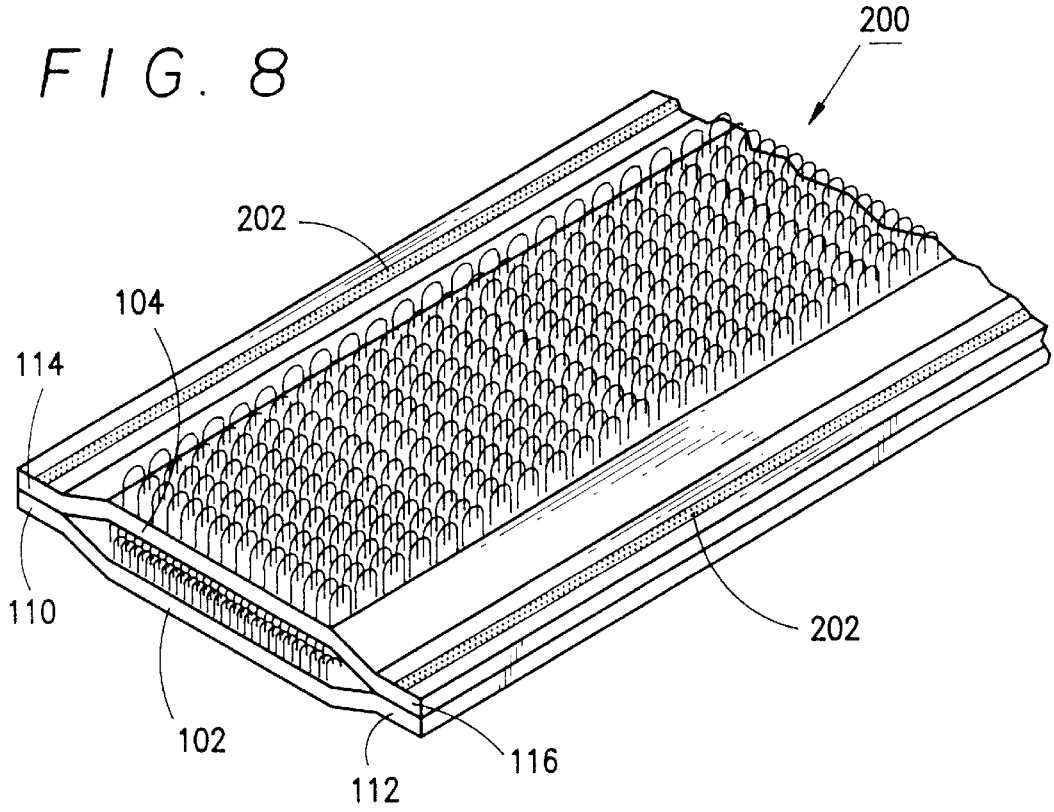
FIG. 8 shows a detail view of an additional embodiment of the fastener assembly using a bond strip.

Turning now to FIG. 8, another embodiment of the fastener assembly 200 is shown. The first fastener strip 102 also includes a first edge 110 and a second edge 112. Likewise, the second fastener strip 104 includes a first edge 114 and a second edge 116. The edges 110 and 112 of the first fastener strip 102 are bonded to the edges 114 and 116 of the second fastener strip 104. In this embodiment, a continuous bond strip 202 is shown along the entire length of the fastener assembly 200. The preferred method of bonding is via an ultrasonic weld. However, it should be noted that any bonding method including sonic welding, welding, sewing and gluing can be used as long as the bond can be broken without destroying fastener strips 102 and 104.

Figure 9:
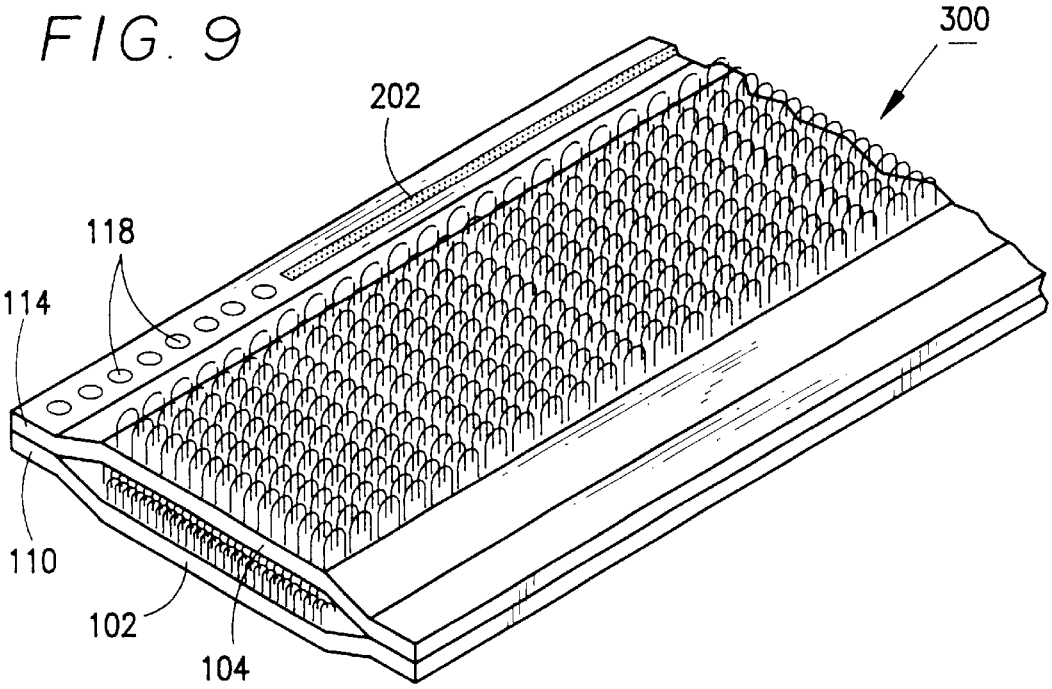
FIG. 9 shows a detail view of another embodiment of the fastener assembly bonded along a single edge.

FIG. 9 shows an additional embodiment of the present invention. Fastener assembly 300 includes a first fastener strip 102 and a second fastener strip 104. The first fastener strip 102 also includes at least a first edge 110. Likewise, the second fastener strip 104 includes at least a first edge 114. The edge 110 of the first fastener strip 102 is bonded to the edge 114 of the second fastener strip 104. Only edges 110 and 114 are bonded. In this embodiment, a continuous bond strip 202 and a series of bond points 118 are shown along the entire length of the fastener assembly 200. Usually, only one method of bonding is used. However, both can be used at once. Any bonding method is acceptable as long as the bond can be broken without destroying fastener strips 102 and 104.

Figure 10:
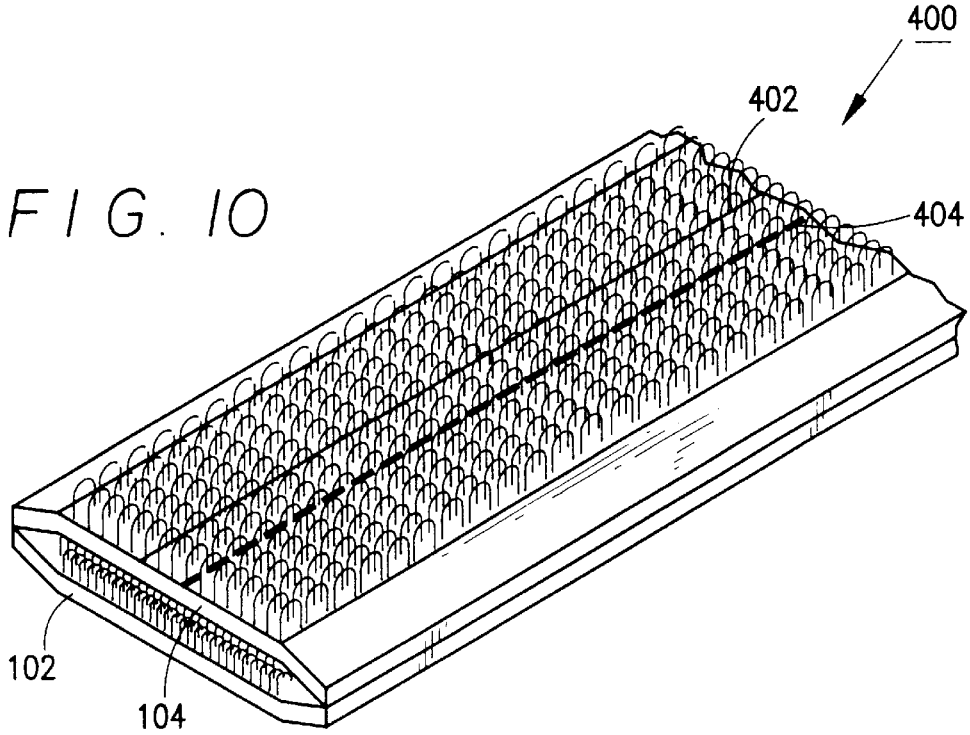
FIG. 10 shows a detail view of another embodiment of the fastener assembly bonded along a portion of the fastener strips.
Figure 11:
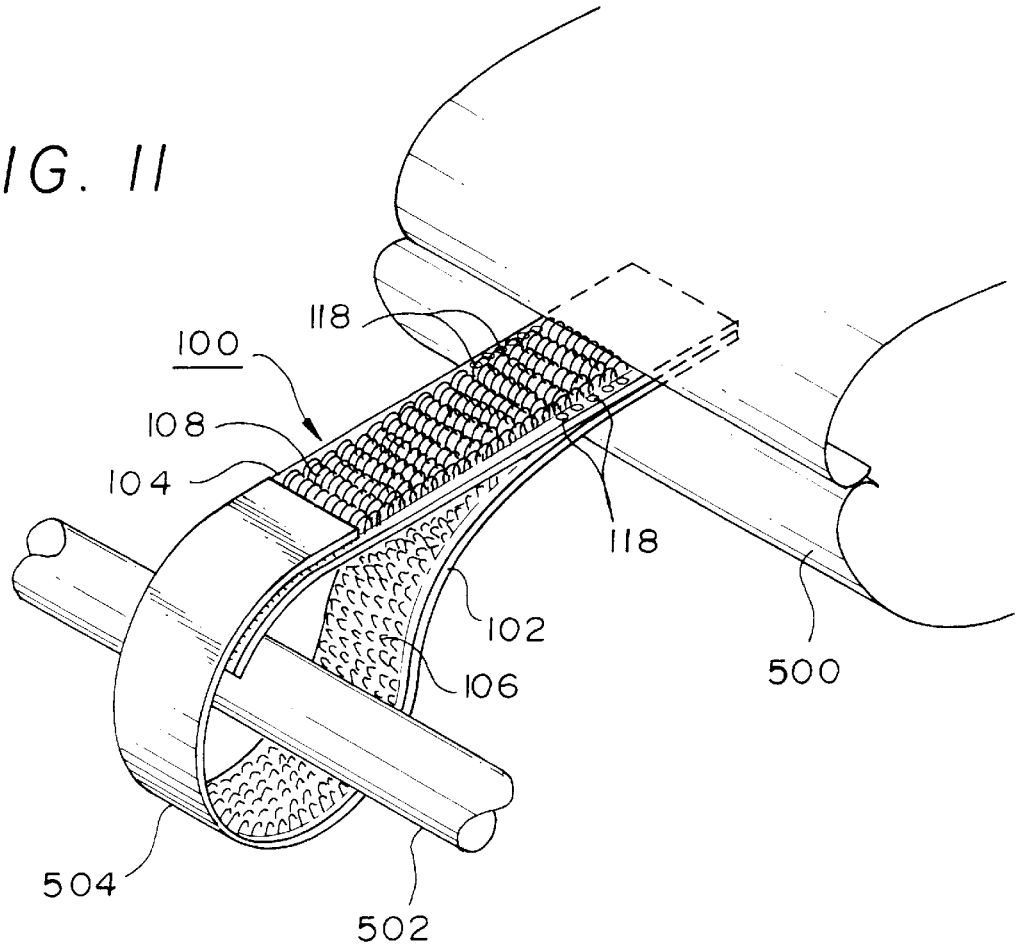
FIG. 11 shows an environmental user of the fastener assembly.

FIG. 10 shows an additional embodiment of the present invention. Fastener assembly 400 includes a first fastener strip 102 and a second fastener strip 104. In this embodiment, no edges are required. Any bonding method discussed above can be used. A continuous bond 402 or a series of bond points 404 can be placed along the length of the fastener assembly 400. As discussed above, any bonding method can be used as long as the bond is releasable. Referring now to FIG. 11 an environmental use of the fastener assembly 100 is shown. The fastener assembly 100 is attached to a product 500. The product 500 can be any product, which needs to be temporarily attached to another object 502. The bonds 118 are broken and first fastener strip 102 and the second fastener strip 104 are wrapped around the object 502 such that the first fastening face 106 over laps and meets with the second fastening face 108 in an area 504. The product 500 is now temporarily attached to the object 502 and can easily be removed.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A fastener assembly comprising:

a first fastener strip having on at least one side a first fastening surface;

a second fastener strip having on at least one side a second fastening surface which is complementary to the first fastening surface; and means for releasably connecting the first fastener strip to the second fastener strip other than the first and second fastening surfaces, wherein the first fastener strip overlies the second fastening surface of the second fastener strip with the first fastening surface not facing the second fastening surface.

2. The fastener assembly of claim 1, wherein the first fastener strip is releasably connected to the second fastener strip by a series of sonic welds.

3. The fastener assembly of claim 1, wherein the first fastener strip is releasably connected to the second fastener strip by a series of spot welds.

4. The fastener assembly of claim 1, wherein the first fastener strip is releasably connected to the second fastener strip by threads.

5. The fastener assembly of claim 1, wherein the first fastener strip is releasably connected to the second fastener by adhesive.

6. A fastener assembly comprising:

a first fastener strip having on at least one side a first fastening surface, a first edge not covered by the first fastening surface;

a second fastener strip having on at least one side a second fastening surface which is complementary to the first fastening surface and a second edge not covered by the second fastening surface; and wherein the first fastener strip overlies the second fastening surface of the second fastener strip with the first fastening surface not facing the second fastening surface and wherein the first fastener strip is releasably connected to the second fastener strip along the first edge of the first fastener strip and the second edge of the second fastener strip.

7. The fastener assembly of claim 6, wherein the first edge and second edge are releasably connected by a series of sonic welds.

8. The fastener assembly of claim 6, wherein the first edge and second edge are releasably connected by a series of spot welds.

9. The fastener assembly of claim 6, wherein the first edge and second edge are releasably connected by adhesive.

10. The fastener assembly of claim 6, wherein the first edge and second edge are releasably connected by threads.

11. A fastener assembly comprising:

a first fastener strip having on at least one side a first fastening surface, a first edge not covered by the first fastening surface and a second edge not covered by the first fastening surface;

a second fastener strip having on at least one side a second fastening surface which is complementary to the first fastening surface, a first edge not covered by the second fastening surface and a second edge not covered by the second fastening surface; and wherein the first fastener strip overlies the second fastening surface of the second fastener strip with the first fastening surface not facing the second fastening surface and wherein the first fastener strip is releasably connected to the second fastener strip along the first edges and second edges of the first fastener strip and the second fastener strip.

12. The fastener assembly of claim 11, wherein the first and second edges of the first and second fastener strips are releasably connected by a series of sonic welds.

13. The fastener assembly of claim 11, wherein the first and second edges of the first and second fastener strips are releasably connected by a series of spot welds.

14. The fastener assembly of claim 11, wherein the first and second edges of the first and second fastener strips are releasably connected by adhesive.

15. The fastener assembly of claim 11, wherein the first and second edges of the first and second fastener strips are releasably connected by threads.

16. A fastener assembly having a predetermined length, comprising:

a first fastener strip having on at least one side a first fastening surface;

a second fastener strip having on at least one side a second fastening surface which is complementary to the first fastening surface; and means for releasably connecting the first fastener strip to the second fastener strip along the length of the fastener assembly other than the first and second fastening surfaces, wherein the first fastener strip overlies the second fastening surface of the second fastener strip with the first fastening surface not facing the second fastening surface.

17. The fastener assembly of claim 16, wherein a series of bonds releasably connect the first fastener strip to the second fastener strip.

18. The fastener assembly of claim 17, wherein the series of bonds are sonic welds.

19. The fastener assembly of claim 16, wherein a continuous bond releasably connects the first fastener strip to the second fastener strip.

20. The fastener assembly of claim 19, where the continuous bond is created by a sonic welder.

* * * * *